US010494882B2

(12) United States Patent
Unander et al.

(10) Patent No.: US 10,494,882 B2
(45) Date of Patent: Dec. 3, 2019

(54) PIPE STORAGE AND HANDLING

(71) Applicant: National Oilwell Varco Norway AS, Kristiansand S (NO)

(72) Inventors: Nils Stian Unander, Lillesand (NO); Carl Henrik Oscar Helander Jansson, Kristiansand (NO); Magnus Erik Johansson, Kristiansand (NO)

(73) Assignee: National Oilwell Varco Norway AS, Kristiansand S (NO)

( * ) Notice: Subject to any disclaimer, the term of this patent is extended or adjusted under 35 U.S.C. 154(b) by 0 days.

(21) Appl. No.: 15/535,847

(22) PCT Filed: Dec. 17, 2014

(86) PCT No.: PCT/NO2014/050240

§ 371 (c)(1),
(2) Date: Jun. 14, 2017

(87) PCT Pub. No.: WO2016/099280

PCT Pub. Date: Jun. 23, 2016

(65) Prior Publication Data

US 2017/0362904 A1 Dec. 21, 2017

(51) Int. Cl.

| | |
|---|---|
| ***E21B 19/00*** | (2006.01) |
| ***E21B 19/06*** | (2006.01) |
| ***E21B 19/14*** | (2006.01) |
| ***E21B 19/16*** | (2006.01) |
| ***E21B 19/24*** | (2006.01) |

(52) U.S. Cl.

CPC ..... *E21B 19/146* (2013.01); *E21B 19/008* (2013.01); *E21B 19/06* (2013.01); *E21B 19/16* (2013.01); *E21B 19/24* (2013.01)

(58) Field of Classification Search

CPC ..... E21B 19/146

See application file for complete search history.

(56) References Cited

U.S. PATENT DOCUMENTS

| | | | | |
|---|---|---|---|---|
| 4,061,233 | A | 12/1977 | Benjamin | |
| 5,167,400 | A * | 12/1992 | Gazel-Anthoine | B66B 1/28 254/275 |
| 8,052,370 | B2 | 11/2011 | Dekker et al. | |
| 2008/0304939 | A1 * | 12/2008 | Dekker | E21B 19/146 414/22.63 |
| 2012/0305261 | A1 * | 12/2012 | Roodenburg | E21B 15/02 166/352 |
| 2013/0206478 | A1 | 8/2013 | Selzer et al. | |

FOREIGN PATENT DOCUMENTS

| | | | | |
|---|---|---|---|---|
| WO | WO-2012061506 | A2 * | 5/2012 | E21B 19/06 |

OTHER PUBLICATIONS

International Patent Application No. PCT/NO2014/050240 International Search Report and Written Opinion dated Aug. 21, 2015 (9 pages).

* cited by examiner

*Primary Examiner* — David J Bagnell
*Assistant Examiner* — Dany E Akakpo
(74) *Attorney, Agent, or Firm* — Conley Rose, P.C.

(57) ABSTRACT

A system for storing and handling pipes between a pipe rack and a derrick includes pipe-receiving chambers that are positioned around a centre region, and an elevator for lifting and descending the pipes into the chambers. The elevator, located in the centre region in between the receiving chambers, is configured for selecting one of the receiving chambers and for lifting and descending a respective pipe into the selected chamber.

20 Claims, 6 Drawing Sheets

PIPE STORAGE AND HANDLING

CROSS REFERENCE TO RELATED APPLICATIONS

This application is a 35 U.S.C. § 371 national stage application of PCT/NO2014/050240 filed Dec. 17, 2014, incorporated herein by reference in its entirety for all purposes.

STATEMENT REGARDING FEDERALLY SPONSORED RESEARCH OR DEVELOPMENT

Not applicable.

BACKGROUND

The invention relates to a system for storing and handling pipes between a pipe rack and a derrick, and to a rig comprising such system.

Pipe stands are typically lengths of piping made up of two or more single pipes. Hereinafter, the term "pipe" refers to both single pipes as well as pipe stands.

When producing petroleum products, use is made of a drilling derrick, which forms part of a rig. The rig may be situated either onshore or offshore. Offshore, the rig may be a fixed structure standing on the seabed, or it may be a floating structure, which is either tethered to the seabed or dynamically positioned.

The main function of the drilling derrick is to provide suspension for winching equipment that is used to lower a drill string, riser, casing and other continuous pipe strings down to or into a well, as well as lifting the drill string out of the well.

A time-critical factor of drilling operations and other operations that involve lowering and retrieval of a long pipe string (also referred to as "tripping") is the transport to and from the drilling derrick. It has therefore been desirable to store stands (consisting of 2, 3 or 4 drill pipes) as close to the derrick as possible. However, space is highly restricted in this area, as other essential equipment must also be stored here. Another argument for moving the stands away from the actual drilling deck is that placing them at a lower level would lower the centre of gravity. Thus, these storage racks near the drilling derrick can hold only a limited number of pipes.

Much effort has gone into developing equipment that will provide rapid transport of stands to the drilling derrick, in some cases directly to the drilling centre (the line followed by the pipe string through the derrick). It is equally important to be able to quickly remove pipes that have been detached from the pipe string.

Great emphasis has also been placed on the safety aspects involved in the development of this type of pipe handling equipment. Consequently more and more automated equipment has been developed, requiring a minimum number of personnel on the drilling deck (or drill floor).

One element that has been developed to make the pipe handling more efficient is the use of a so-called mousehole, which is a storage area on a drilling rig where the next joint of a (drilling) pipe is held until needed. Conventionally, the mousehole was typically located in the floor of the rig and usually lined with a metal casing known as a scabbard. Such mousehole made it possible to bring in a stand, which is then ready for subsequent transport to the drilling centre as soon as the need arises. Assembling a stand is typically done by first placing one pipe in the mousehole and then screwing another pipe down onto the top of the first pipe. This may be followed by a more pipes being screwed onto the bottom of the first two, which then have to be lifted up before this coupling operation. It is also possible to temporarily store stands that are removed from the drilling centre pending onwards transport to the pipe rack, or stands can be dismantled in the mousehole and the pipes then transported separately to the pipe rack. It is also possible to assemble/disassemble stands at the drilling centre but this will slow the tripping down considerably.

In the prior art improvements on the mousehole have also been reported. For example, U.S. Pat. No. 8,052,370B2 discloses a system for handling pipes between a pipe rack and a derrick. The derrick is located on a drilling deck, in connection with the production of petroleum products. The system comprises means of carrying pipe lengths between the rack and the derrick. It also comprises a unit at the drilling deck for temporary storage of at least two pipe lengths in respective receiving chambers. The receiving chambers can be moved to and from at least one receiving and/or hand-over position, in which position a pipe handling unit is arranged to hand over a pipe length to a receiving chamber and/or retrieve a pipe length from a receiving chamber. The up and down moving of the pipe lengths is done using one elevator for all chambers or one elevator for each chamber. The elevator is driven by a driving apparatus, which comprises a hydraulic motor and an endless chain extending between two sprocket wheels or gear wheels. The unit may be rotatable and located under an opening in the drilling deck. The problem with this pipe handling system is that it requires a lot of space, while there is not much space available on a rig, and particularly not near or in the derrick. There is thus a need for improvement of the system.

BRIEF SUMMARY OF THE DISCLOSURE

Embodiments disclosed herein have potential to remedy or to reduce at least one of the drawbacks of the prior art, or at least provide a useful alternative to prior art.

In a first aspect, this disclosure relates to embodiments having a system for storing and handling pipes between a pipe rack and a derrick. The system comprises:

a plurality of receiving chambers for receiving said pipes, wherein said receiving chambers are positioned around a centre region, and an elevator for lifting and descending said pipes into said chambers, characterised in that the elevator is located in the centre region in between said plurality of receiving chambers, and that the elevator is configured for selecting one of said plurality of receiving chambers and for lifting and descending a respective pipe within said respective chamber.

Effects of this combination of the features are as follows. Rather than placing one endless chain elevator per receiving chamber or at the outer side of a turret comprising said receiving chambers, as is disclosed in the U.S. Pat. No. 8,052,370B2, this embodiment conveniently provides said elevator in the centre region between said receiving chambers. The inventors have realized that this not only saves a lot of space, which is very costly on a rig, but it also renders the design of the system much easier. This embodiment further prescribes that the elevator is configured for selecting one of said plurality of receiving chambers for lifting and descending a respective pipe within said respective chamber. This latter feature is rendered very easy to implement by placing the elevator in the centre region. It will be understood that there is many different ways in which such elevator may be designed, yet this description will mainly focus on one advantageous embodiment, while the invention is not limited to such embodiment.

In an embodiment of a system in accordance with the disclosure, the elevator is configured for selecting one of said plurality of receiving chambers by a relative rotation between said elevator and said plurality of receiving chambers. Said relative rotation constitutes a convenient implementation of an elevator system, which is capable of selecting a specific one of said plurality of receiving chambers.

In an embodiment, the elevator comprises a guide, and an arm extending from the guide, wherein the arm is slideable within the guide. Said arm is further configured for engaging with and lifting up said respective pipe. The exemplary system further comprises an arm actuator for sliding said arm within said guide. This embodiment is advantageous, because of its simplicity. The respective pipes are moved up and down by simply sliding said actuating arm such that it slides up and down, respectively and engages with a bottom side of said pipe. Engaging in this respect both includes direct engagement as well as indirect engagement (for example via a so-called cradle, which is known from the prior art, as such).

In an embodiment, the arm and the plurality of receiving chambers are freely rotatable with respect to each other when the arm is positioned at a bottom position below said receiving chambers. This embodiment implies that whenever another receiving chamber is selected by the elevator the arm must first go down to the bottom position, whereafter said relative rotation may be effected.

In an embodiment, the arm actuator comprises a cable that is coupled with the arm and extends therefrom through the guide towards a location near a drilling deck from where it can be actuated. In this embodiment, the actuating of the arm is simply done by pulling said cable towards the drilling deck in case the pipe needs to be lifted out of the receiving chamber, or by releasing said cable in a controlled manner such that gravity will make the pipe descend into the receiving chamber.

An embodiment of a system in accordance with the disclosure further comprises a winch system that is placed on or near the drilling deck for actuating said arm via said cable. A winch system constitutes a very convenient way of controlling said cable. Moreover, the winch system may be conveniently placed almost anywhere on the deck, for example further away from the system in case there is not enough space close to the system.

In an embodiment, the arm comprises a hook-formed tool, also being referred to as the "Rabbit", connected to the cable, which is connected to the winch system. The rabbit will engage with the cradle in the respective receiving chamber which is located in the so-called pipe eject position underneath the hole in the drill floor. In an embodiment, the rabbit will always stay in the pipe eject position by means of the guide, also being referred to as the "Rabbit Guide".

In an embodiment, said plurality of receiving chambers are placed in a turret, wherein said turret is rotatable with respect to the derrick. A turret-based mousehole system is known from U.S. Pat. No. 8,052,370B2 and such turret may also be applied to this exemplary embodiment.

In an embodiment, said relative rotation between said elevator and said plurality of receiving chambers is achieved by rotating the turret. This embodiment exploits the rotatability of the turret for allowing the selecting of a specific one of said receiving chambers by the elevator.

An embodiment of a system in accordance with the disclosure may further comprise a safety device for aborting or preventing said relative rotation in case said elevator is not in a free rotating position or has got stuck. This embodiment is particularly advantageous when combined with the embodiment having the guide and arm. If the arm gets stuck in the guide, for instance halfway the slide, and the relative rotation would be initiated, severe damage to the system could be the result. Hence, the safety device in this embodiment prevents such rotation from happening or aborts it when it occurs during rotation.

An exemplary embodiment may further comprise a further safety device for aborting or preventing said lifting or descending of said pipe in case the arm has got stuck. This embodiment is also particularly advantageous when combined with the embodiment having the guide and arm. If the arm gets stuck in the guide, for instance halfway the guide, and the arm would be lifted it could take the guide together with it and consequently severe damage to the system could be the result. Hence, the safety device in this embodiment prevents such lifting from happening or aborts it when it occurs during sliding of the arm.

In an embodiment, each of said plurality of receiving chambers comprises a cradle, which is movable up and down the receiving chamber and is configured for receiving said pipes at an upper side thereof. Said arm is configured for engaging with a bottom side of said cradles. The use of a cradle as such is known from the prior art, but they can be conveniently used in combination with the embodiment disclosed herein.

In an embodiment, said the disclosed system comprises three receiving chambers placed in a triangle, wherein said elevator is placed in the middle of said triangle. In this embodiment, the triangular placement of said receiving chambers automatically defines a centre region, which in accordance with at least this embodiment, is conveniently used for placing the elevator.

In an embodiment, said system comprises two receiving chambers placed in a line, wherein said elevator is placed in between said receiving chambers. This embodiment may be applied to mouseholes having two receiving chambers or more.

In a second aspect, the disclosure relates to a rig comprising the system described above. Clearly a rig may benefit greatly from such system, because the resulting system for storing and handling pipes requires less space and is easier to build and thereby also less costly.

An embodiment of the rig in accordance with the disclosure further comprises a drilling deck, a derrick, a pipe rack, and wherein the system is placed at the drilling deck in proximity of the derrick.

BRIEF DESCRIPTION OF THE DRAWINGS

Exemplary embodiments are described in the accompanying drawings, wherein.

DETAILED DESCRIPTION OF THE DISCLOSED EXEMPLARY EMBODIMENTS

It should be noted that the above-mentioned and below-described embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The mere fact that certain measures are recited in mutually different dependent claims does not indicate that a combination of these measures cannot be used to advantage.

Figure 1:
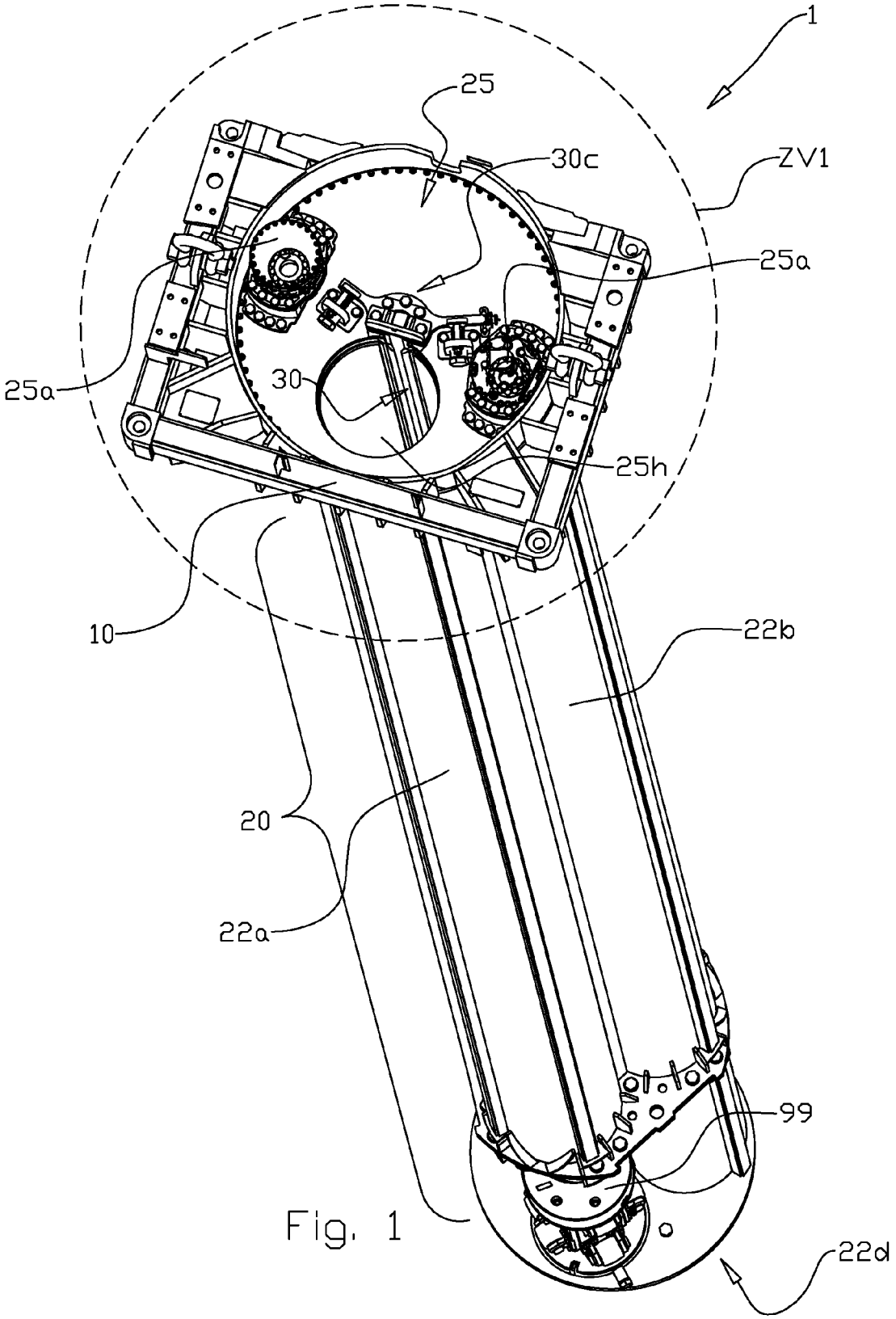
FIG. 1 shows a perspective view of an embodiment of the system in accordance with the disclosure.

FIG. 1 shows a perspective view of an exemplary embodiment of the system 1 for storing and handling pipes in accordance with the disclosure. For the sake of simplicity only the system 1 has been drawn and all other parts of the rig have completely left out. The figure shows a system 1 (also referred to as "mousehole") comprising of a chamber unit 20 (or rack unit) which comprises three receiving chambers 22*a*, 22*b* of which only two are visible in this perspective view. The receiving chambers 22*a*, 22*b* are configured for receiving said pipes (not shown). In an embodiment said receiving chambers 22*a*, 22*b* have an internal diameter of 18 inch (45 cm) and are oriented around a circle around a centre line (in case of three receiving chambers it could be stated that they are oriented on the corners of an isosceles triangle). It must be stressed that receiving chambers having different diameters may be employed, and that the system may have a different number of receiving chambers. This all depends on the application. At an upper side of said chamber unit 20 there is an interface box 10, which is typically welded to a drill floor (not shown). The interface box 10 comprises a frame in which a rotatable turret 25 is mounted. Said receiving chambers 22*a*, 22*b* are mounted within said turret 25 and thereby rotatable also. Said turret 25 may be rotated by actuating turret actuators 25*a*. The exemplary system 1 further comprises an elevator 30, which, in this embodiment, is provided in a centre region 30*c* of the chamber unit 20. The elevator 30 does not necessarily have to be exactly in the middle of the chamber unit 20. However, such symmetric configuration is considered much easier to implement in particular because of the rotatability of the turret 25. In any case, the feature "centre region" 30*c* is to be interpreted as the whole region in between said receiving chambers 22*a*, 22*b*. At an upper side 22*u* of the receiving chambers 22*a*, 22*b* there is visible a hole 25*h* which gives access to one of said chambers 22*a*, 22*b* by rotating said turret 25 to the corresponding position. At a bottom side 22*d* of the receiving chambers 22*a*, 22*b* there is visible one of a plurality of cradles 99. Each of said cradles 99 is moveable up and down each respective receiving chambers 22*a*, 22*b* and is configured to receive a bottom part of a respective pipe (not shown).

Figure 2:
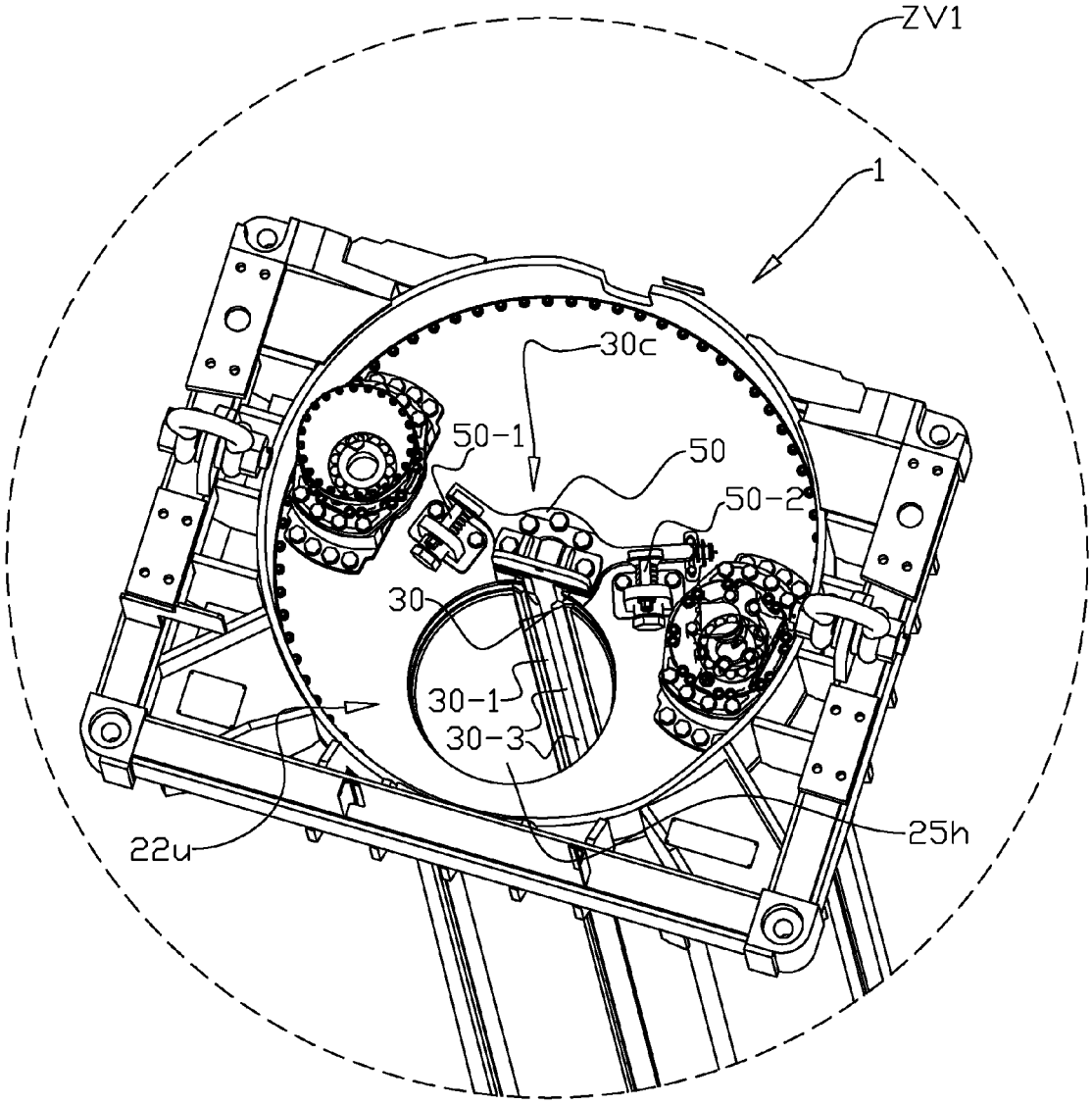
FIG. 2 shows an enlarged view of the system of part of FIG. 1.

FIG. 2 shows an enlarged view ZV1 of the system 1 of part of FIG. 1. The figure shows more clearly that the elevator 30 comprises a guide 30-1 having a slit 30-3. The slit 30-3 serves to guide an arm 30-2 in a sliding manner (not shown in FIG. 2, but shown in FIGS. 4 and 5).

Figure 3:
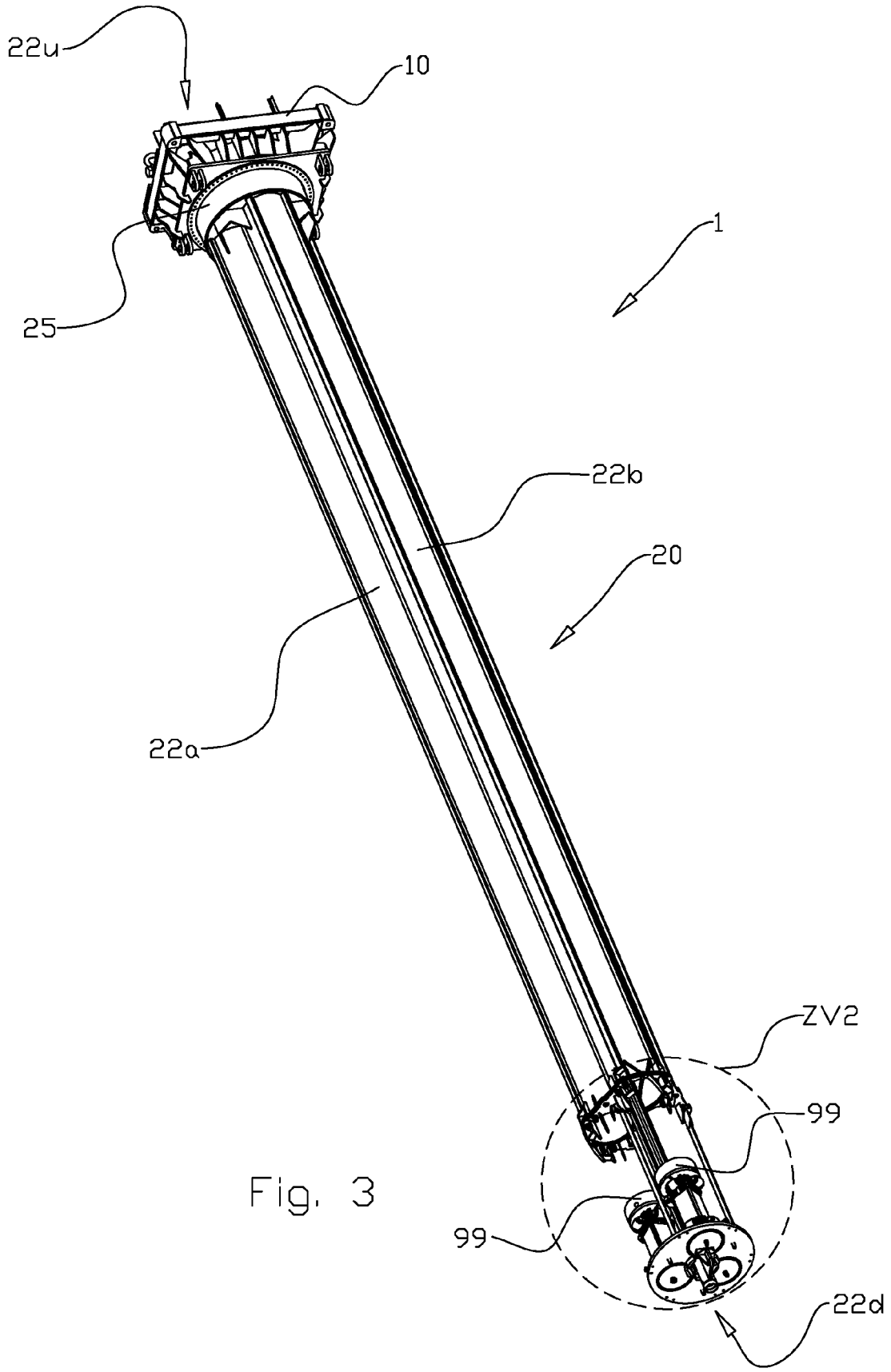
FIG. 3 shows a further perspective view of the system of FIG. 1.
Figure 4:
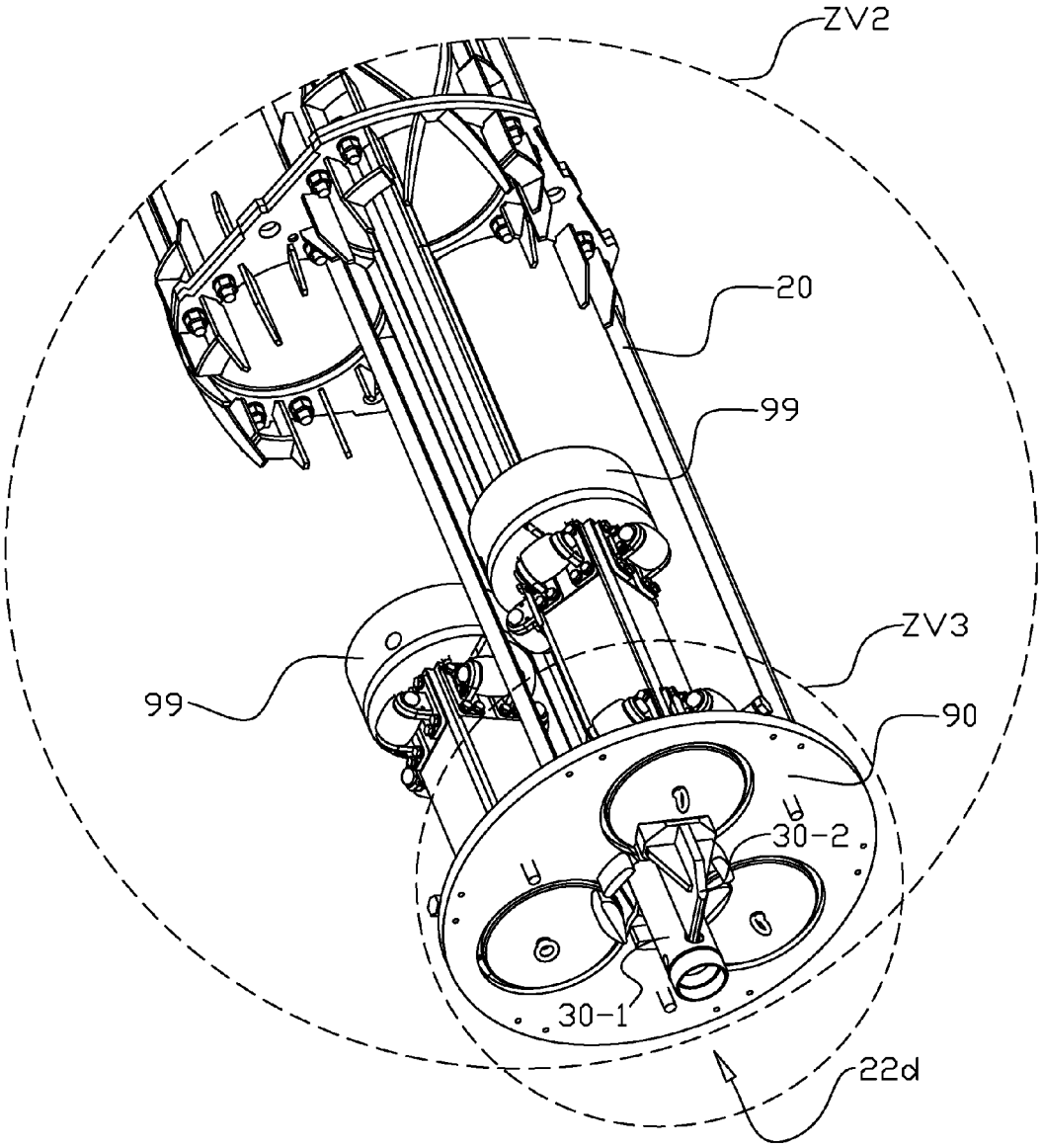
FIG. 4 shows an enlarged view of part of FIG. 3.
Figure 5:
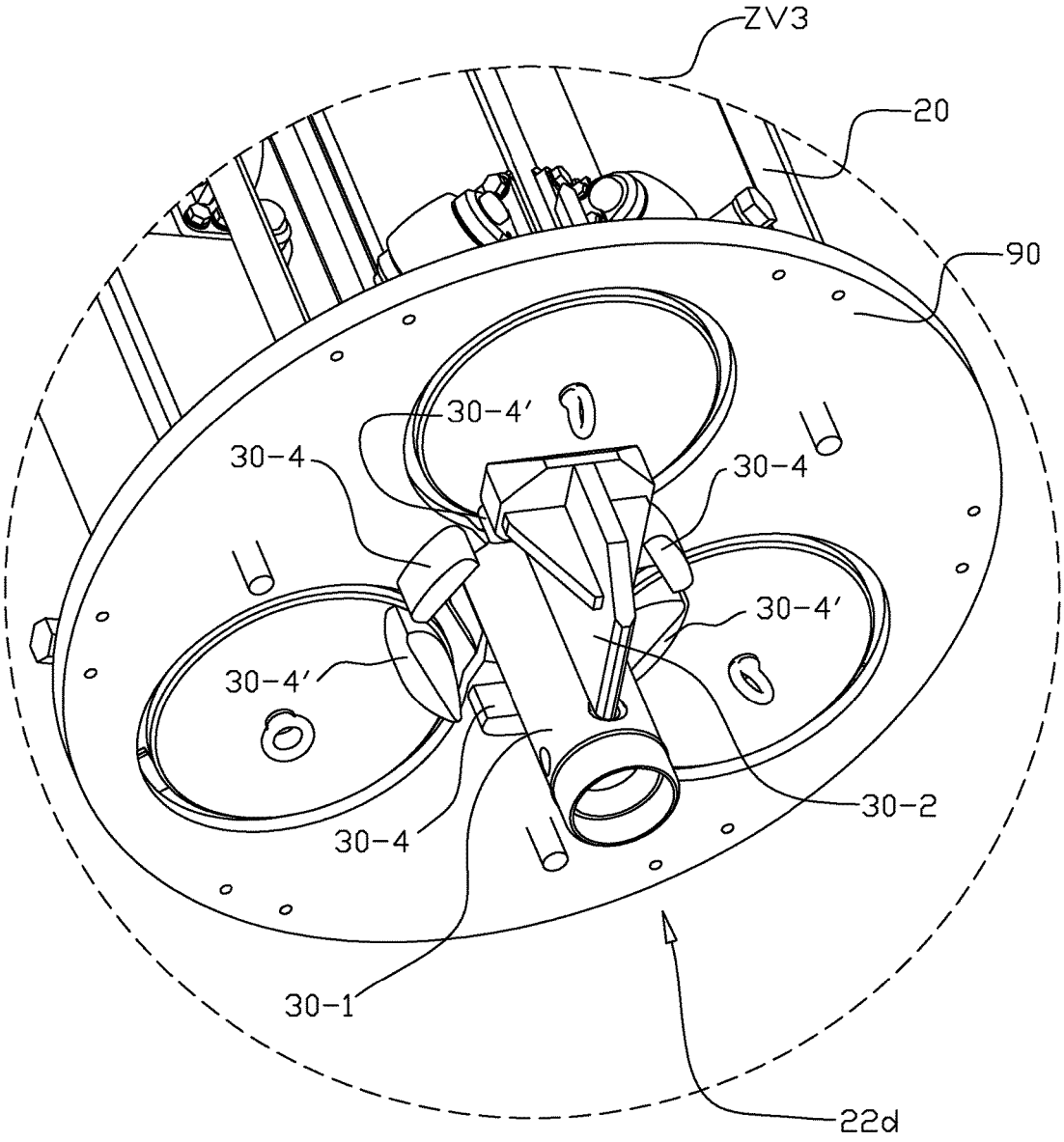
FIG. 5 shows an enlarged view of part of FIG. 4.

FIG. 3 shows a further perspective view of the system 1 of FIG. 1 when viewed from the bottom side 22*d*. In order to show parts which would otherwise be hidden, the chamber unit 20 has been "broken open" at the bottom side 22*d*. In practise said receiving chambers 22*a*, 22*b* are closed at the bottom side 22*d*. FIG. 4 shows an enlarged view ZV2 of part of FIG. 3. FIG. 5 shows a further enlarged view ZV3 of part of FIG. 4. In FIG. 4 two of said cradles 99 are shown. Also shown is the guide 30-1, which extends to a location beyond the bottom side 22*d* of said receiving chambers 20*a*, 20*b*. The figures further show the arm 30-2, which is slideable within the guide 30-1. In this embodiment, the arm 30-2 can "select" one of said receiving chambers 22*a*, 22*b* (for handling) by relative rotation between the assembly comprising the guide 30-1 and arm 30-2 and the chamber unit 20. The arm 30-2 engages with the bottom side 22*d* of a respective cradle 99.

As can be derived from FIGS. 3 to 5, the arm 30-2 will keep its orientation because of the guide 30-1 when the chamber unit 20 is rotating. In order to keep the position of the arm 30-2 while rotating a plurality of guiding plates 30-4, 30-4' is implemented (see FIG. 5). Three of said guiding plates 30-4' are hook-up anchors to the bottom of said cradles 99, while the other three of said guiding plates 30-4 are fixed to the bottom flange 90 of chamber section 20.

Figure 6:
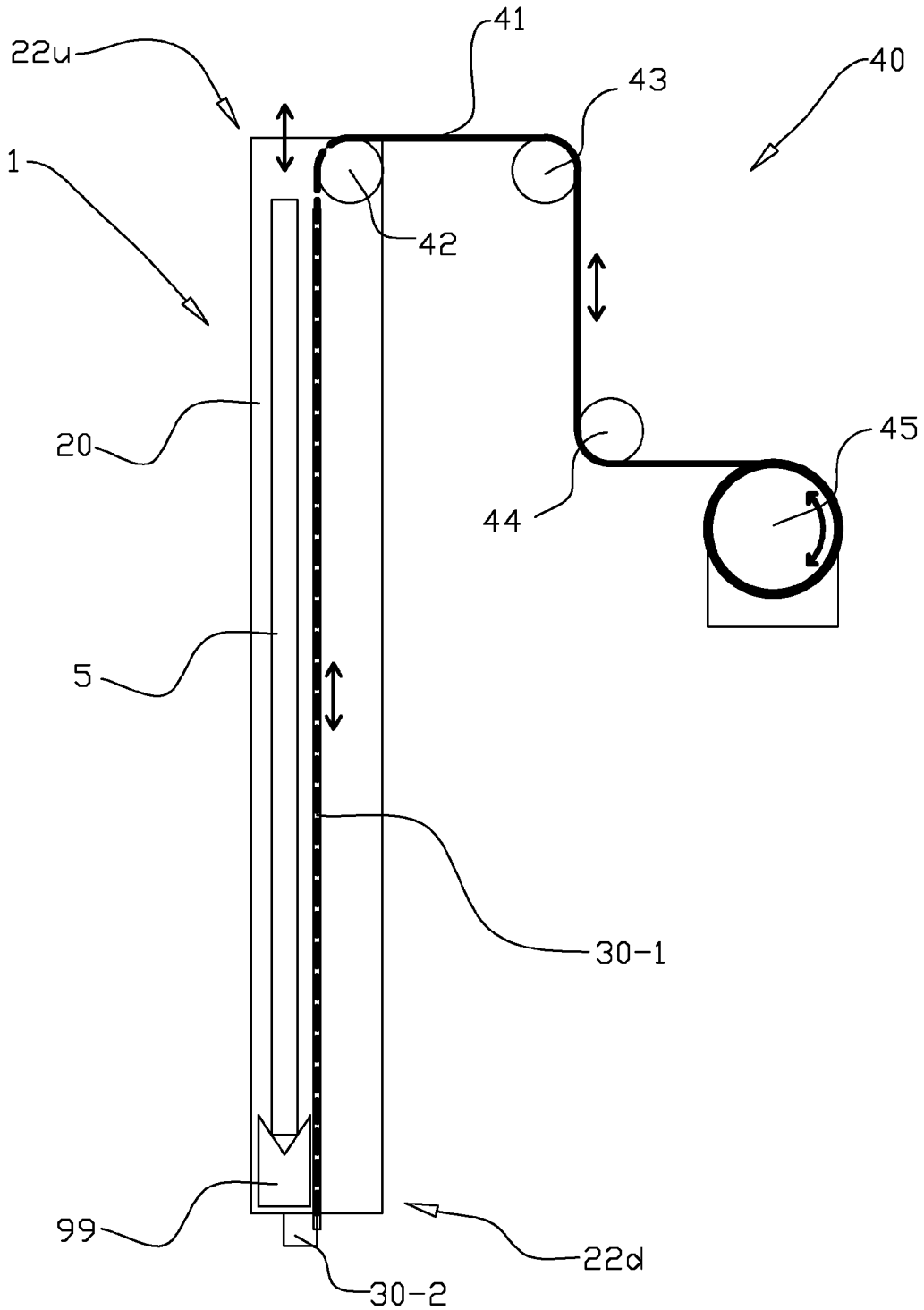
FIG. 6 shows a schematic representation of a winch system in accordance with another embodiment of the system.

FIG. 6 shows a schematic representation of a winch system in accordance with another exemplary embodiment. FIG. 6 illustrates a possible implementation of an arm actuator 40. In this embodiment, the arm 30-2 is coupled to a cable 41 that runs through the guide 30-1 towards a winch system that is provided at the upper side 22*u* of the chamber unit 20. When moved up the arm 30-2 engages with a bottom side 22*d* of the cradle 99 onto which a pipe 5 is resting. The cable 41 is fed to a winch system comprising a first wire sheave 42 at the upper side 22*u* of the chamber unit 20, a second wire sheave 43 and a third wire sheave 44 towards a freestanding powered winch 45. The wire sheaves 42, 43, 44 are there to change the direction of the cable 41. The total number of required sheaves and their position may vary depending on the situation. Lifting and descending the pipe 5 within said receiving chamber is simply done by pulling or releasing said cable 41 using the winch system 42-45. This is also illustrated by the arrows in FIG. 6.

Embodiments disclosed herein may also relate a safety system, which will be discussed with reference to FIG. 2, which shows the enlarged view of the system of part of FIG. 1. In case a guide 30-1 and arm 30-2 are used as elevator 30, it could theoretically happen that the turret 30 is rotated while the arm 30-2 is still within the slit 30-3 and not in its freely-rotating position at the bottom side 22*d* of the chamber unit 20. Such a situation may occur because of dried mud within the guide 30-1 for example. The arm 30-2 may simply get stuck and not drop towards its lowest position in which it can freely rotate. When the chamber unit 20 forces rotation on the guide 30-1 via the arm 30-2 the guide 30-1 may be twisted and eventually destroyed leading to the system being out of operation. In order to prevent this from happening a safety device 50 may be provided as illustrated in FIG. 2. This safety device 50 comprises a cantilever that is provided at the upper side 22*u* of the guide 30-1. In the example of FIG. 2, the cantilever comprises factually two spring-loaded cantilevers 50-1, 50-2. The spring-loading of said cantilevers 50-1, 50-2 ensures that the guide 30-1 has a preferred orientation. At respective ends of said cantilevers 50-1, 50-2 there is provided sensors (not shown) for sensing a relative movement between the cantilever 50-1, 50-2 and its spring-load fixing point. Such sensor may be an inductive sensor for example. The output of the sensors is fed to a control system, which in the event of a changing sensor output will shut down the system. The same safety device 50 can be used for preventing another hazardous situation, namely when the arm 30-2 is lifted while it is stuck in the guide 30-1. If that happens the cable will pull the arm 30-2 together with the guide 30-1 up, which will cause the cantilevers 50-1, 50-2 to be lifted from the surface. Consequently, said inductive sensors will detect this and give a signal to the control system shutting the system down. In this embodiment both safety measures are combined into one safety device, but it could also be separate systems.

One or more embodiment disclosed herein may provide for an improved mousehole (system for storing and handling pipes), which is able to store three tubulars (pipes) at the same time, or even more. Such mousehole may be implemented below the drill floor (drill deck) and effectively feed the tubulars in a stand building operation. When a multi-chamber system such as the one in the invention is used for building stands, the operator is able to save a lot of time when handling the tubulars because the system can be loaded by both the stand-building machine as well as the so-called V-door machine, while a column racker (for instance a "Hydra Racker"™ from the applicant) is used for removing or storing the finished stand. When the Hydra Racker is back and ready to build a new stand the mousehole is fully loaded with single tubulars.

For implementation aspects of the disclosed embodiments onto a rig, reference is made to U.S. Pat. No. 8,052,370B2, the entire disclosure of which is hereby incorporated into this disclosure by this reference. U.S. Pat. No. 8,052,370B2 illustrates the mousehole and its implementation on a rig. It must be noted that the system of this disclosure may also be applied in other application areas than the petroleum industry. Reference is also made to U.S. Pat. Nos. 4,050,590 and 4,061,233 which disclose further details on other turret or carrousel type mouseholes, which use more than three holes. The embodiments disclosed herein are also applicable to the systems disclosed in U.S. Pat. Nos. 4,050,590 and 4,061,233, the entire disclosures of said patents being hereby incorporated into this disclosure by this reference.

The invention claimed is:

1. A system for storing and handling pipes between a pipe rack and a derrick, the system comprising:

a plurality of receiving chambers for receiving the pipes, wherein each receiving chamber includes a corresponding longitudinal axis, and wherein the receiving chambers are positioned around a centre region; and an elevator for lifting and descending the pipes into the chambers, wherein the elevator comprises:

an elongate guide that is located in the centre region in between the plurality of receiving chambers;

an arm extending from the guide, wherein the arm is slideable within the guide;

wherein the elevator is configured to selectively align with a selected one of the chambers, and wherein the arm is configured to lift a respective pipe out of the selected chamber from a lower end of the respective pipe, in an axial direction with respect to the longitudinal axis of the selected chamber.

2. The system according to claim 1, wherein the elevator is configured to align with the selected chamber by a relative rotation between the elevator and the plurality of receiving chambers.

3. The system according to claim 2, wherein the plurality of receiving chambers are placed in a turret, and wherein the turret is rotatable with respect to the derrick.

4. The system according to claim 3, wherein the relative rotation between the elevator and the plurality of receiving chambers is achieved by rotating the turret.

5. The system according to claim 2, further comprising a safety device configured to detect a rotation of the guide along with the plurality of receiving chambers and to abort the relative rotation between the elevator and the receiving chambers.

6. The system of claim 5, wherein the safety device comprises a cantilever coupled to the guide, wherein the cantilever is rotationally biased to maintain a rotational position of the guide, and wherein rotation of the guide with the plurality of receiving chambers is configured to rotate the cantilever.

7. The system according to claim 2, further comprising a safety device configured to abort or prevent lifting or descending of the pipe in case the arm gets stuck.

8. The system according to claim 2, wherein each of the plurality of receiving chambers comprises a cradle, which is movable up and down the receiving chamber and is configured for receiving the pipes at an upper side thereof, wherein the arm is configured for engaging with a bottom side of the cradles.

9. The system according to claim 2, wherein the system comprises three receiving chambers placed in a triangle, wherein the elongate guide is placed in the middle of the triangle.

10. The system according to claim 2, wherein the system comprises two receiving chambers placed in a line, wherein the elongate guide is placed in between the receiving chambers.

11. The system according to claim 2, wherein the receiving chambers are configured to rotate about the elevator so as to align the elevator with the selected chamber.

12. The system according to claim 11 wherein the arm is slidable within the guide.

13. The system according to claim 12 further comprising a cable coupled with the arm and extending through the guide towards the derrick, the cable being configured to be pulled by a winch.

14. The system according to claim 11 wherein the guide is positioned in the middle of the centre region.

15. The system according to claim 1, further comprising an arm actuator comprising a cable that is coupled with the arm and extends therefrom through the guide towards a location near a drilling deck from where the cable can be actuated.

16. The system according to claim 15, further comprising a winch system near the drilling deck for actuating the arm via the cable.

17. A rig comprising: a drilling deck, a derrick, a pipe rack, and a system for storing and handling pipes between a pipe rack and a derrick, the system comprising:

a plurality of receiving chambers for receiving said pipes, wherein said receiving chambers are positioned around a centre region, and wherein each receiving chamber includes a longitudinal axis; and an elevator configured to lift and descend the pipes out of and into, respectively, the chambers in an axial direction with respect to the corresponding longitudinal axis;

wherein the elevator comprises an elongate guide that is located in the centre region in between said plurality of receiving chambers, and wherein the elevator is configured to selectively align with a selected one of the plurality of receiving chambers; and wherein the system is placed at the drilling deck in proximity of the derrick.

18. The rig of claim 17 further comprising:

an arm extending from the guide, wherein the receiving chambers are configured to rotate about the elevator so as to align the elevator with the selected chamber; and a cable coupled with the arm and extending through the guide towards the derrick, the cable being configured to be pulled by a winch.

19. The rig of claim 17, further comprising a safety device configured to detect a rotation of the guide along with the plurality of receiving chambers and to abort the relative rotation between the elevator and the receiving chambers.

20. The rig of claim 19, wherein the safety device comprises a cantilever coupled to the guide, wherein the cantilever is rotationally biased to maintain a rotational position of the guide, and wherein rotation of the guide with the plurality of receiving chambers is configured to rotate the cantilever.

* * * * *